United States Patent [19]

Büchler et al.

[11] Patent Number: 4,909,474

[45] Date of Patent: Mar. 20, 1990

[54] APPARATUS FOR LOCATING OPERATIONAL SURFACES ON A TRACK FOR ELECTROMAGNETICALLY LEVITATED VEHICLES

[75] Inventors: Wilhelm Büchler, Haar; Walter Lippert, Münich; Lorenz Maier, Otterfing, all of Fed. Rep. of Germany

[73] Assignee: Dyckerhoff & Widmann Aktiengesellschaft, Fed. Rep. of Germany

[21] Appl. No.: 354,504

[22] Filed: May 19, 1989

Related U.S. Application Data

[62] Division of Ser. No. 194,383, May 16, 1988, Pat. No. 4,854,028.

[30] Foreign Application Priority Data

May 15, 1987 [DE] Fed. Rep. of Germany ..... 3716260

[51] Int. Cl.[4] ..... B28B 7/00; B22D 19/00; B25B 27/14

[52] U.S. Cl. ..... 249/1; 29/281.5; 29/281.6; 29/281.4; 269/43; 269/45; 249/83

[58] Field of Search ..... 29/452, 460, 281.5, 29/281.6, 281.4; 264/261, 263; 249/83, 86, 90, 23, 1; 269/43, 45

[56] References Cited

U.S. PATENT DOCUMENTS

| | | | |
|---|---|---|---|
| 3,055,090 | 9/1962 | Murphy | 29/281.6 X |
| 3,341,639 | 9/1967 | Naillon | 264/261 X |
| 3,791,309 | 2/1974 | Baermann | 104/286 X |
| 3,848,034 | 11/1974 | Schaefer | 264/263 X |
| 3,908,975 | 9/1975 | Bryant | 29/281.5 X |
| 4,064,808 | 12/1977 | Nakamura et al. | 104/286 |
| 4,253,817 | 3/1981 | Stinton | 264/261 X |
| 4,277,141 | 7/1981 | Kleiber | 264/261 X |
| 4,604,250 | 8/1986 | Ecker | 249/90 X |
| 4,616,395 | 10/1986 | Farese et al. | 29/460 |
| 4,626,299 | 12/1986 | Knight et al. | 264/261 X |

*Primary Examiner*—Charlie T. Moon

*Attorney, Agent, or Firm*—Toren, McGeady & Associates

[57] ABSTRACT

On a track for electromagnetically levitated vehicles, side guide rails are positioned on and secured to a beam-like support member forming the track by an apparatus made up of a transportation frame extending in the long direction of the support member and by installation truss frames located on and extending transversely of the transportation frame. Side guide rail installation arms are pivotally mounted on the installation truss frames. With the arms in an outward position the guide rails can be placed on and held by the arms. By pivoting the arms inwardly the side guide rails can be located along the outer sides of the support member. By raising the installation truss frame, the guide rails can be located relative to stators mounted on the underside of the support member. In addition, the final position of the guide rails can be established by moving the installation truss frames transversely of the transportation frame and relative to a plate strip on the upper surface of the support members.

25 Claims, 7 Drawing Sheets

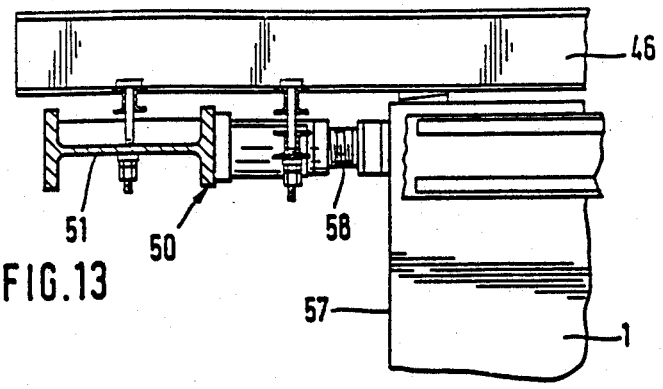
FIG.13
FIG.14
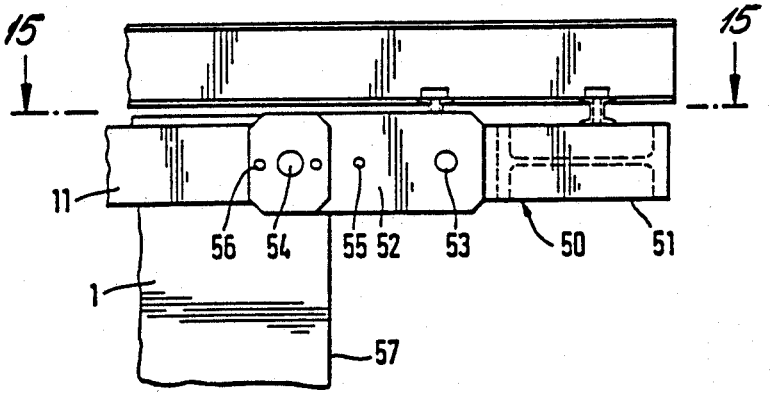
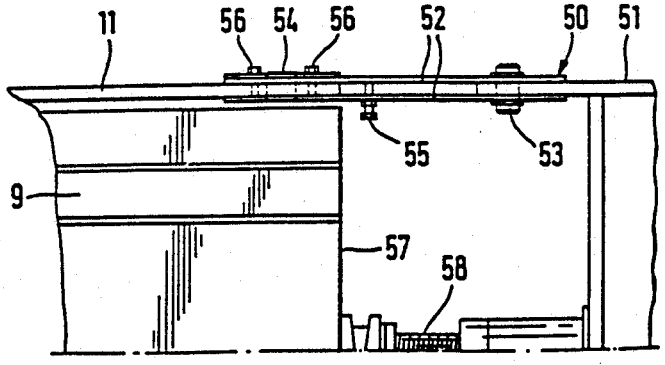
FIG.15

APPARATUS FOR LOCATING OPERATIONAL SURFACES ON A TRACK FOR ELECTROMAGNETICALLY LEVITATED VEHICLES

This is a division of application Ser. No. 104,383, filed May 16, 1988, now U.S. Pat. No. 4,854,028.

BACKGROUND OF THE INVENTION

The present invention is directed to a method of and apparatus for the adjustment and attachment of operational surfaces on a track for electromagnetically levitated vehicles. The track is a beam-like support member formed of steel, reinforced or prestressed concrete. The support member has a deck slab mounted on a box-like girder member with parts of the deck slab cantilveered outwardly on both sides of the girder member. The operational surfaces include stators located on the underside of the cantilevered parts and side guide rails extending on and secured to the outer sides of the cantilevered parts.

A known track for a high speed railroad using electromagnetically levitated vehicles include track supports in the form of single span beams constructed from prestressed concrete and located on elevated piers. Operational elements for the electromagnetic levitation technology are located on the track supports and the elements provide the operational surfaces required for the support, guidance, drive, and braking as well as for data transmission from the control center and current supply to the vehicle. Note the German magazine "Bauingenieur" (Civil Engineer), 1983, pages 129 to 134. In this known track, the track support has a closed, approximately trapezoidally shaped cross-section with an upper deck plate cantileveed outwardly on both sides from support webs of the closed cross-section. Operational elements for the levitating vehicles are located in the region of the cantilevered parts, that is, support stators from electroplates and cable windings fixed between the cantilevered parts, rails for side guidance of the vehicle and for the transmission of braking forces fixed on the outer sides of the cantilevered parts as well as slide surfaces located along the upper surface of the deck slab of the support member with the side surfaces supporting the vehicles when they come to rest during stoppage and during possible malfunction of the electromagnetic system.

These operational elements have operational surfaces which must be positioned with great accuracy in view of the high speeds of the levitating vehicles. Accordingly, where track supports of reinforced or prestressed concrete are used, the tolerances usually present in concrete construction must be compensated.

An apparatus is known for avoiding the individual installation and adjustment of the operational elements which is very time and work consuming, and in which the elements can be installed and adjusted in one working operation. Note DE-OS No. 31 39 636. The essential feature of the apparatus involves different machining or processing devices located on a single machine frame so that the machine frame can travel on the track supports and can be fixed to the track supports for performing individual machining steps with the machining devices being adjustable with reference to external check or datum points by means of surveying technology equipment for providing accurate positioning of the operating elements. Because of the tolerances in concrete track supports which can not be avoided in construction operations and because of the tolerances in surveying operations which can not be completely eliminated even when the greatest care is exercised, this known apparatus has deficiencies or disadvantages.

SUMMARY OF THE INVENTION

Therefore, it is the primary object of the present invention to provide for the positioning of side guide rails relative to the track support with the required accuracy. and with as little effort as possible, and to adjust the position of the guide rails an attach them to the track support.

In accordance with the present invention, after the stators have been adjusted and secured to the support member, the side guide rails are positioned in spaced relationship to one another and are retained fixed in this position. Subsequently, the side guide rails are positioned relative to the support member forming the track and are adjusted in the vertical position relative to the datum plane formed by the underside of the stators. Next, one of the two side guide rails is located at accurately fixed points of one of the corresponding plate strips on the upper surface of the support member with adjustments in the transverse direction of the track and finally the guide rails are secured to the support member.

The basic concept of the invention involves bringing the side guide rails, which are to be positioned at a specific distance from one another, into this spaced relation prior to their installation and to lock the guide rails in the desired position so that they can be located in one common working operation with respect to the support member of the track and to secure them to the support member. As a result, the side guide rails can be adjusted in the vertical direction by a simple lifting step relative to the datum plane of the underside of the stators. Adjustment in the lateral direction can be effected by a lateral displacement until one of the side guide rails contact accurately positioned fixed points, so that additional correction and adjustment of the opposite guide rails is unnecessary. This operation has the considerable advantage that possible tolerances occur at most only once and thus can not accumulate.

It is preferable to install the side guide rails at constant ambient temperature in a workshop for reliable observation of the required tolerances, and the guide rails and the track support member are prefabricated as finished parts and remain in the workshop until they reach th ambient temperature.

The abutment of one of the two side guide rails with reference to the cantilevered parts of the support member is achieved at previously installed spacers with the side guide rails being made to contact the spacer by lateral displacement transverse to the long direction of the support member. Preferably, distance pins are used as spacers which can be fastened to the support member with an adjustable projection beyond the support member.

In accordance with the invention, the side guide rails can be located and fixed as one continuous member along the full length of the support member.

By securing the one piece side guide rails over the entire length of the track support member in a frictional locked manner, it is possible that the support member as well as the side guide rails participate in the carriage of existing external load permitting an increase in the load carrying ability and stiffness of the support member.

The frictionally locked connection also prevents the occurrence of gap motion between the side guide rails and the track support member.

With track support members constructed of reinforced or prestressed concrete, it is also possible to prestress the side guide rails after adjustment by applying a longitudinal tensile force and to secure the guide rails in the prestressed state at least to the ends of the support in a force transmitting manner. If the longitudinal tensile force prestressing the side guide rails before their attachment to the track support member is appropriately selected, a compressive prestress can be placed on the concrete support member directly after the installation of the side guide rails and then the support member exerts a certain compressive prestress on the side guide rails because of redirected forces caused by creeping and shrinkage. This entails that the doweling forces which have to be transmitted between the support member and the rails are kept lower than would be the case if the side guide rails were not prestressed.

With the track support member formed of reinforced or prestressed concrete, the side guide rails are preferably secured at their ends to steel anchor members embedded into the support member and this can be accomplished by welding. The side guide rails, in addition to the above-described attachment, can be secured along their length by anchor bolts extending into recesses in the support member and by injecting a hardenable material, such as cement mortar, into the recesses An apparatus for carrying out the above method is also part of the invention. The apparatus is made up of a number of spaced parallel installation truss frames located along and above the upper surface of the track support. Assembly arms are located at the opposite sides of the installation truss frames with the arms capable of extending below the support member into the region below the stators. The assembly arms have means for, holding a side guide rail and an abutment for engaging with the underside of the corresponding stator Further, the apparatus includes a transportation frame extending in the long direction of the track support member and the transportation frame can be placed on the upper surface of the support member and extends for the length of the support member. The installation truss frames are supported so that they can be displaced transversely of and can be adjusted in the height direction relative to the track support member. This apparatus affords a simple and easily transportable structure on which the side guide rails to be fixed to the support member can be held along the entire length of the support member. Further, the side guide rails can be adjusted relative to the support member in three directions perpendicular to one another, that is, in the long direction of the support member, in the transverse direction relative to the long direction, and in the vertical direction While the alignment in the long direction takes place during the positioning of the transportation frame relative to the track support member, wherein a longitudinal displacement beyond the tensioning means located at the ends of the transportation frame can occur, the positioning is performed in the lateral direction so that the alignment of the side guide rails with respect to the central axis of the track support member is afforded by spacers fastened on one side and measured previously always on the same side of the track support member, and the vertical or height adjustment can be carried out relative to the underside of the previously installed stators.

The installation or assembly arms are pivotally secured at the ends of a cross beam forming the upper part of the installation truss frame. The pivot axis for the arms extends parallel to the long axis or direction of the track support member. Adjustment members, such as arm pivoting cylinders, can be articulated at the cross beam and the installation arms for pivoting the arms. The arms can be locked when pivoted toward the support member to the installation truss frame.

A side adjustment device which contacts the support member can be arranged for the displacement of the installation truss frame transversely of the long direction into the closed state with the device located on one of the arms. The side adjustment device includes a displacement element articulated to the installation arm, for instance, a side actuating cylinder, which acts upon a support rod movable against the support member. The support rod is arranged to contact a slide strip on the upper surface of the support member with the rod extending transversely of the long direction. In addition, the support rod can be fastened to the installation arm so that it is freely pivotally movable around the joint.

Raising or lifting devices, such as lifting cylinders placed on the upper surface of the support member, can be arranged for adjusting the height of the installation truss frames.

The transportation frame is made up of at least two elongated beams interconnecting to one another by transverse beams.

Each of the holding devices on the assembly arms include a lower holding slide movable at right angles to the arm. The side guide rails can be placed on the lower holding slide and an upper holding claw is movable with respect to the upper longitudinally edge of the guide rail. Accordingly, the side guide rails can be placed by means of the holding slide and the holding claw against a rail abutment plate fastened on the installation arm. A displacement member, such as a double acting holding cylinder articulated to the installation arm, can actutate the holding slide and the holding claw.

The abutment on the installation arm placeable against the undersides of the stator can be equipped with force-measuring devices dynamometers.

When the side guide rail is positioned relative to the side of the support member, a sealing element is arranged to seal the gap located between the support member and the guide rails. The sealing element is located at the lower end of the installation arm. Preferably, the sealing element is movable into position against the gap. A displacement, for instance the cylinder articulated to the installation arm, can provide the requisite movement of the sealing element.

Means for centering the installation truss frame relative to the transportation frame can be provided between the transportation frame and the installation truss frames. Accordingly, one displacement device, such as at least one centering cylinder movable transversely of the long direction of the support member can be arranged on the upper side of the transportation frame with the centering cylinder in operative connection with the installation truss frame to which it is assigned.

Preferably, two axially aligned centering cylinders are provided with their opposing position rods acting on the opposite sides of a centering bracket located on a cross beam of the installation truss frames.

At least two installation truss frames are connected with one another by wind-bracing means. Such means are arranged so that it does not impair the height adjustability and the transverse adjustability of the installation truss frames.

A hoist for the side guide rails is located on at least two installation truss frames.

The transportation frame is formed of longitudinally extending beams connected by transverse beams with the longitudinal beams being longer than the support member with their ends projecting beyond the support member. Tensioning devices are located at the ends of the longitudinal beams extending outwardly from the support member. Each tensioning device can include a cross-tie secured at the longitudinal beams with tension butt straps secured at the cross-tie and attachable to the side guide rails. The tensioning devices act against cylinder piston unit abuttable at the support member. The cross-tie is retained at the longitudinal beams so as to be longitudinally displaceable.

For the control of the individual method steps to be accomplished by means of hydraulically actuated cylinder piston units, it is desirable to combine several, preferably three, installation truss fames into one unit and to actuate them as a unit. For correction purposes, however, it should be possible to perform each method step individually at each installation truss frame.

To assure the positional accuracy of the side guide rails, the adjustment members must be locked or the pressure in the individual cylinder piston units must be kept constant during the entire period when the hardenable material, which fasten the anchor bolts of the side guide rails in the recesses, is setting. This can be effected by hydraulic actuation of pressure switches which have to be switched on and off, so that during manual labor no uncontrolled movements are introduced at or with the device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawings:

FIG. 13 is a partial longitudinally extending view through a tension device at one end of the apparatus;

FIG. 14 is a side view of the tensioning device; and

FIG. 15 is a sectional view along the line XV—XV in FIG. 14.

DETAILED DESCRIPTION OF THE INVENTION

Figure 1:
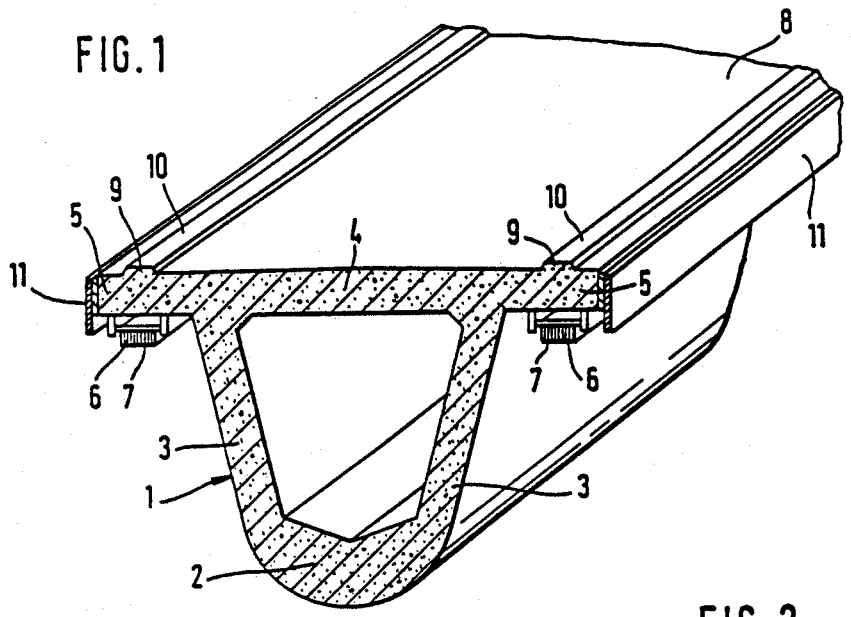
FIG. 1 is a transverse cross-sectional view of a track support member formed of prestressed concrete for magnetically levitated vehicles with operational surfaces illustrated on the support member.

In FIG. 1 the arrangement of operating parts and operating surfaces for an electromagnetically levitated vehicle are shown on a beam-like track support member 1 formed of prestressed concrete with a closed approximately trapezoidal hollow beam cross-section. The beam-like support member 1 includes a base portion 2 rounded at its lower outer surface, an upper deck slab 4 supported by webs 3 extending upwardly from the base portion 2 to the underside of the deck slab 4. The base portion 2, the webs 3 and the lower surface of the deck slab 4 combine to form the hollow trapezoidal section. The deck slab 4 extends laterally outwardly from the webs 3 forming cantilevered parts 5. The support member 1 is elongated, note FIG. 7. The operating surfaces for the running track of the magnetic railroad are located in the region of the cantililevered parts 5

The operating parts include levitating stators 6 located on the undersides of the cantilevered parts 5 with the lower surfaes 7 of the stators forming operating surfaces. These operating surfaces must have a specific spacing from slide surfaces 10 formed on slide strips 9 projecting upwardly from the upper surface of the cantilvered parts 5. Additional operating surfaces are provided by the elongated side guide rails 11 each located along one of the elongated outer sides of of the cantilevered part 5.

Figure 2:
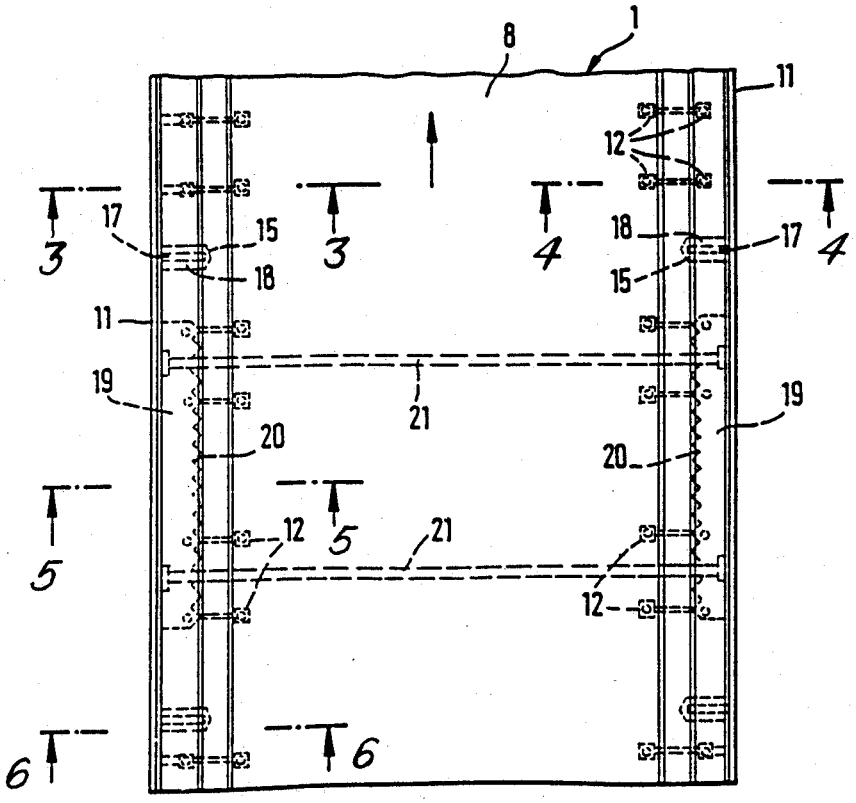
FIG. 2 is a partial plan view illustrating one end of the track support member.
Figure 3:
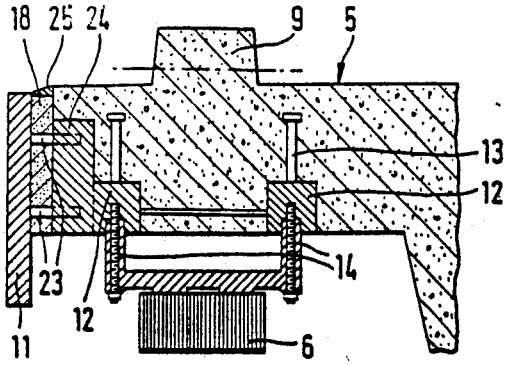
FIG. 3 is a cross-sectional view taken along the line III—III in FIG. 2.
Figure 4:
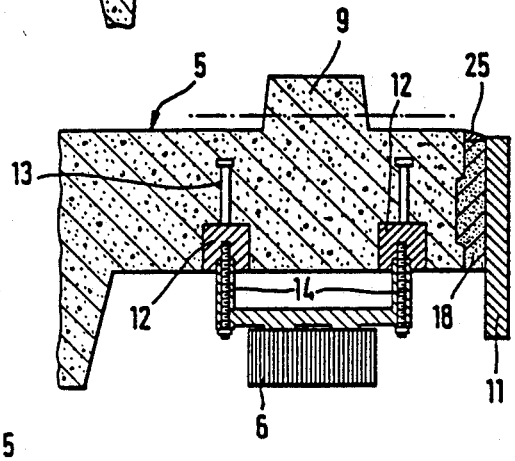
FIGS. 4-6 are cross-sectional views taken in FIG. 2 and shown on a larger scale, with FIG. 3 taken along the line III—III in FIG. 2, FIG. 4 taken along the line IV—IV in FIG. 2, FIG. 5 taken along the line V—V in FIG. 2, and FIG. 6 taken along the line VI—VI in FIG. 2.

The present invention is not directed to the manner in which the stators 6 equipped with stator windings are secured to the underside of the cantilevered parts 5 of the support member 1. It is important that the stators are secured previously to the track support member. As shown in FIG. 2, anchor members 12 including anchor bolts 13 are arranged to be anchored in the concrete of the support member 1. The anchor members 12 and anchor bolts 13 are also shown in FIGS. 3 and 4. The anchor members are spaced apart at distances determined by the dimensions of the stator 6. Threaded bores are provided in the anchor members 12 for the attachment screws 14 of the stator 6.

Various steps are required for aligning, positioning and securing the side guide rails 11, which will be described with the aid of FIGS. 2 to 6.

In FIG. 2 recesses 15 are shown extending into the elongated outer side of the cantilevered parts 5 and the recesses are provided along the elongated direction of the support member 1. The recesses 15 can be provided by hollow molded members 16 incorporated when the support member is concreted. The recesses can also be formed by removable molded members. Recesses 15 are arranged to receive anchor bolts 17 which are preferably welded to the inside surfaces of the side guide rails 11 at appropriate spaces in the elongated direction. The inner surfaces of the guide rails 11 are the surfaces facing inwardly toward the outer sides of the cantilevered parts. After. the final positioning of the side guide rails 11, with the anchor bolt in place within the recesses 15, the recesses are filled with a hardenable material, such as cement mortar 18, note FIGS. 2 and 6.

Figure 5:
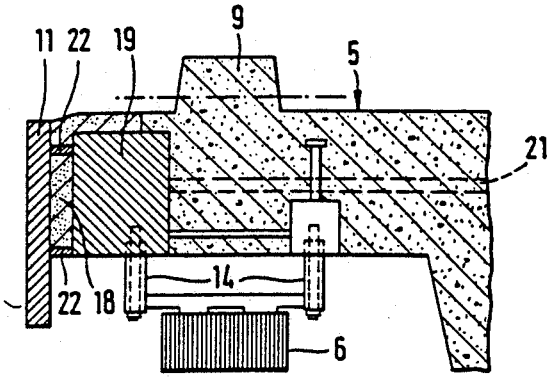
Figure 6:
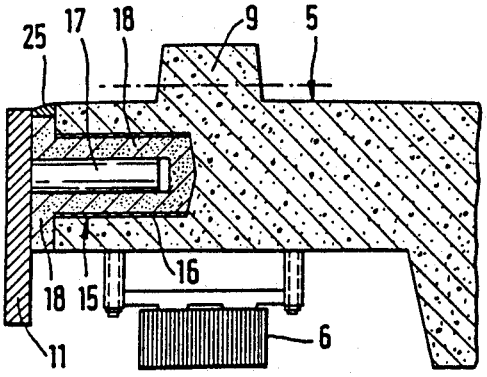

If a tension force in the elongated direction is applied to the side guide rails 11 before they are secured to the support member 1, steel anchoring members 19 are incorporated into the concrete at the end part of the support member 1, as indicated in FIGS. 2 and 5. The anchoring members 19 are provided with a set of teeth extending in the elongaged direction for improving the transmission of shear forces to the concrete body of the support member. Further, tendons 21 extending transversely of the elongated direction interconnect the anchoring members 19 located on opposite sides of the support member 1. As shown in FIG. 5, threaded bores are formed in the anchoring members 19 for receiving the stator attachment screws 14. Spacers 22 are attached along the outer surface of the anchoring members for the alignment and attachment of the side guide rails 11. The side guide rails are secured to the spacers by welding.

Spacer members with a preset length in the form of distance pins 23 are located at preset spaces along the outer surface of the cantilevered parts 5 of the track support member 1. The distance pins 23 are shown in FIG. 3 for positioning the side guide rails 11 in the region of the anchoring members 19. Distance pins 23 are inserted into bores of a predetermined depth in an anchor plate 24, note FIG. 3. Anchor plate 24 can also be connected to one of the anchoring members 12 for the stator attachment screws 14. Distance pins 23 serve to position both side guide rails 11 which are maintained at a spacing from one another by the installation apparatus of the present invention in a manner to be described below. Accordingly, when the guide rail 11 on the right-hand side in FIG. 4 is positioned, simultaneously the other side guide rail on the left-hand side in FIG. 3 is also positioned. After positioning the side rails 11 the space remaining between the side guide rails and the outer surface of the cantilevered part is filled in along with the filling of the recess 15 using a hardenable material such as cement mortar. Further, the space is sealed at the top, note FIG. 3, by a permanently elastic seal 25.

Figure 9:
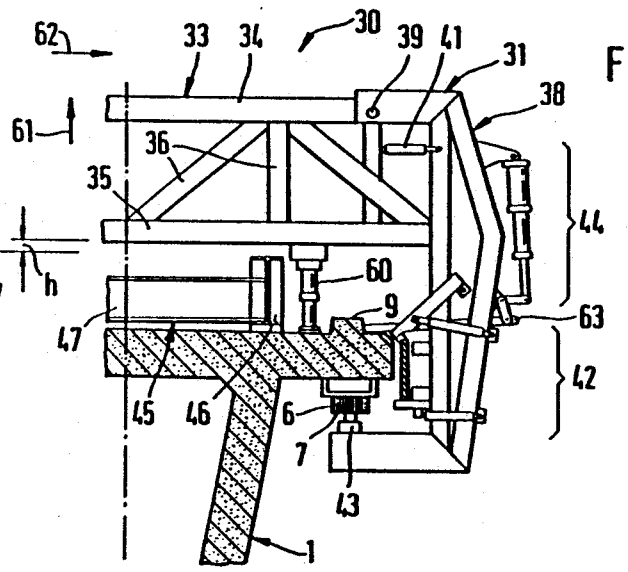
FIG. 9 is an enlarged partial cross-sectional view taken along the line IX—IX in FIG. 7 with the installation arm in the closed position for securing the side guide rail.
Figure 8:
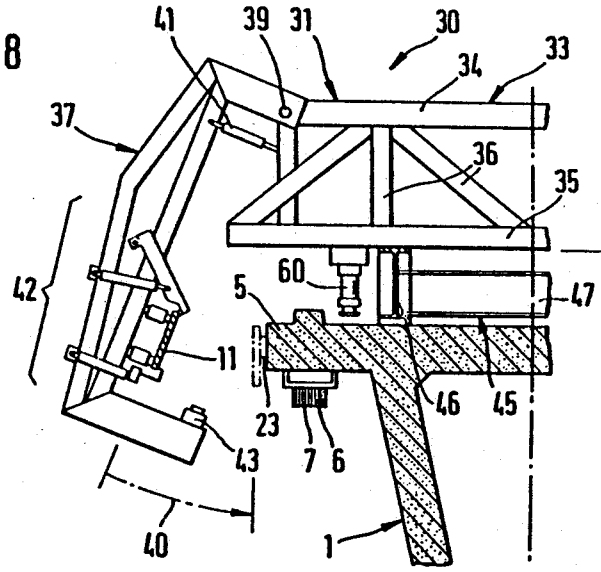
FIG. 8 is an enlarged partial cross-section taken along the line VIII—VIII in FIG. 7 with the installation arm in the open position and with a side guide rail mounted on the arm.
Figure 7:
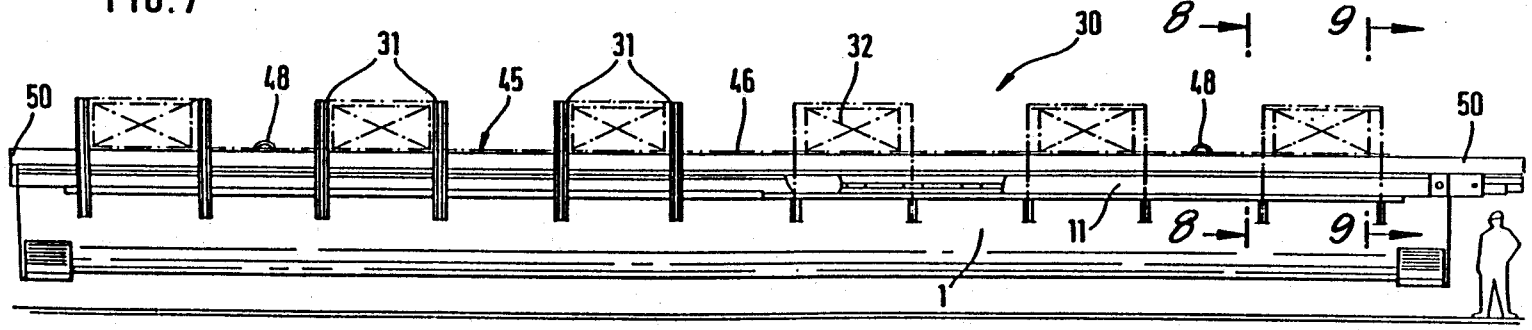
FIG. 7 is a side elevational view of the entire apparatus embodying the present invention.
Figure 10:
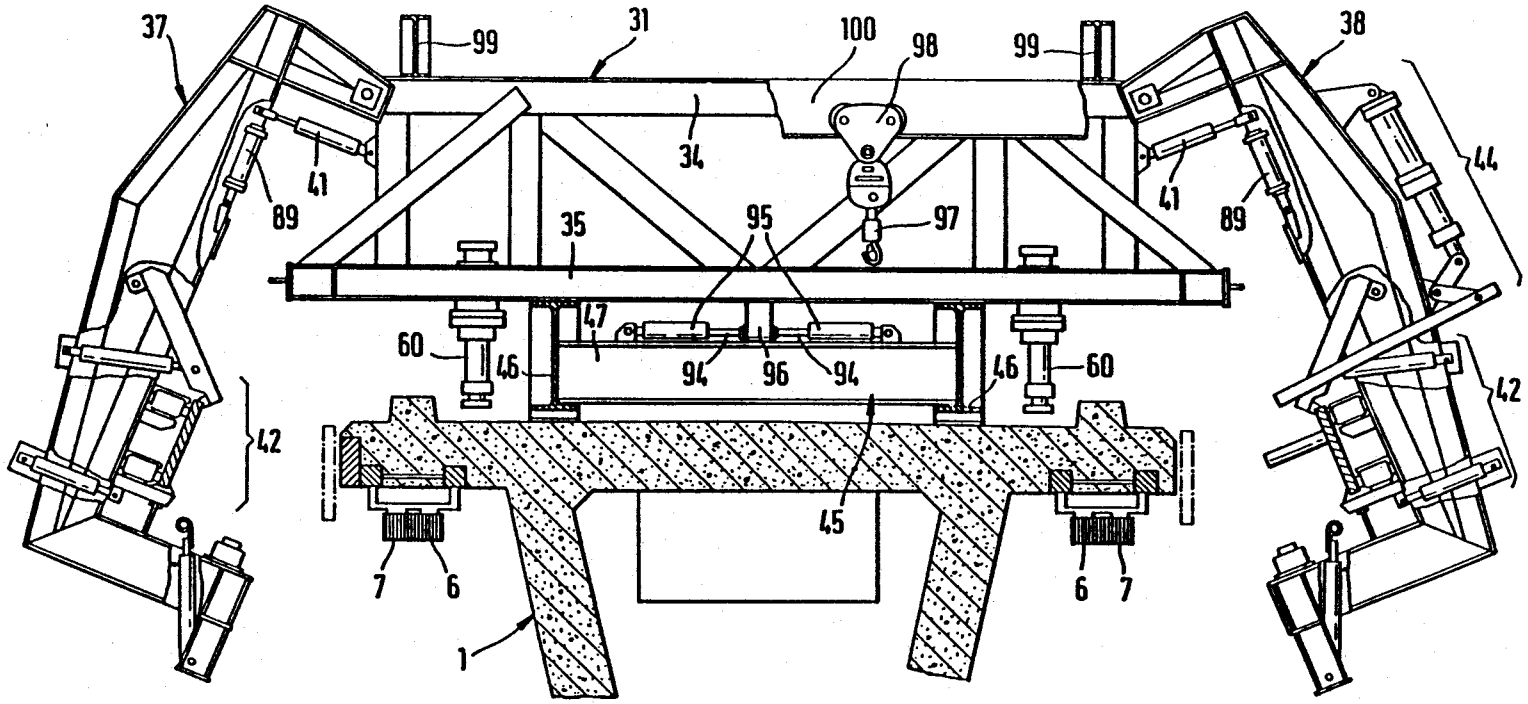
FIG. 10 is a full cross-sectional view of the apparatus with the installation arms shown in the open position.
Figure 11:
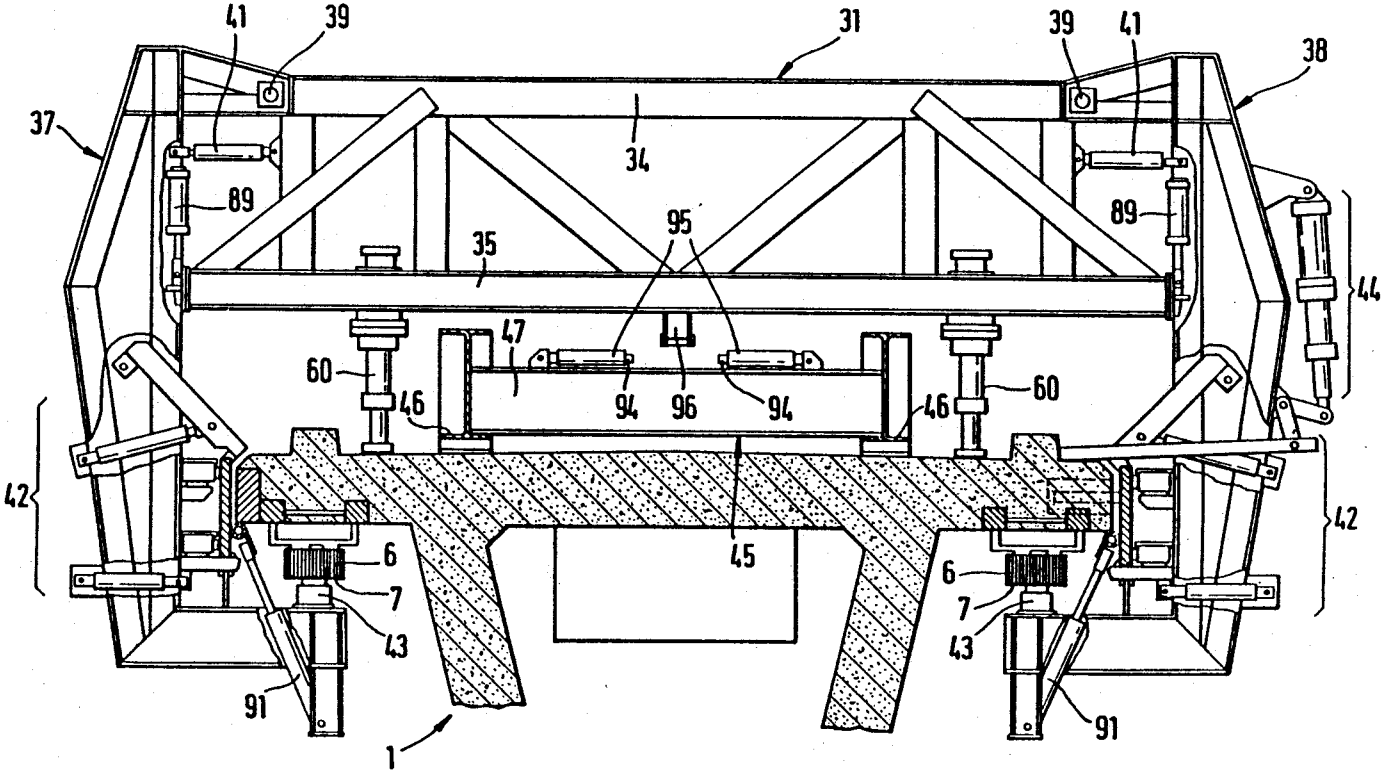
FIG. 11 is a complete cross-sectional view of the installation arms shown in the closed position.
Figure 12:
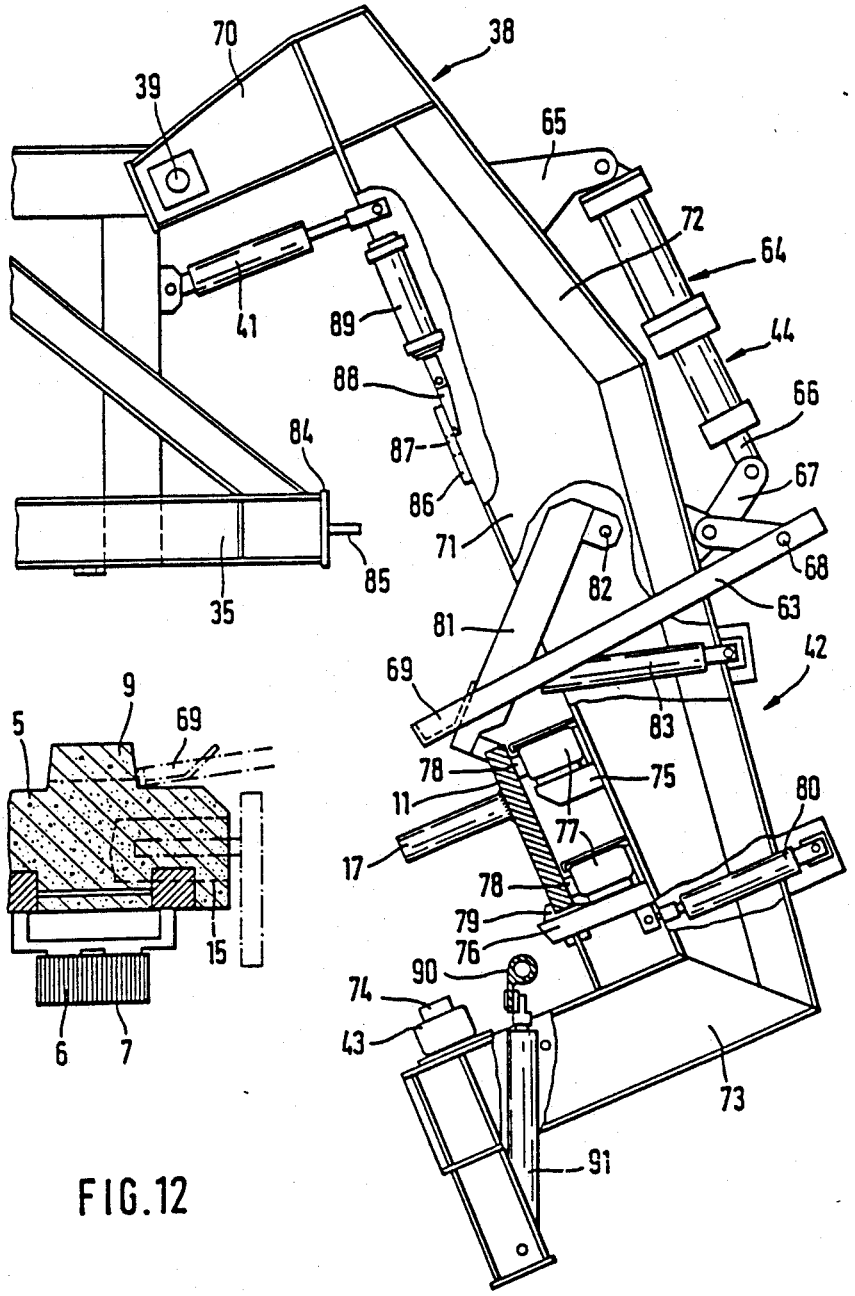
FIG. 12 is an enlarged view of a right-hand installation arm as shown in FIGS. 10 and 11 with the arm displayed in the open position and illustrated on an enlarged scale.

An apparatus 30 for the installation method of the present invention, is illustrated diagramatically in FIGS. 7 to 9 as well as in a more detailed manner in FIGS. 10 to 12.

As shown in FIG. 7, the apparatus 30 includes a plurality of installation truss frames 31 extending transversely of the elongated direction of the support member 1 with the frames uniformly spaced apart along the length of the support member. The truss frames 31 are disposed in parallel relation. As illustrated, two adjacent installation truss frames 31 are retained relative to one another by wind bracing connection 32, however, the interconnection is arranged so that horizontal and vertical movements required for positioning of the side guide rails can be effected independently of one another.

As cnn be seen in FIGS. 8 and 9 each installation truss frame 31 is formed of a truss-like member 33 spaced upwarly from the upper surface of the support member 1. The member 33 has an upper cross beam 34 and a lower cross beam 35 with vertical and diagonal beams 36 interconnecting the upper and lower beams. Each installation truss frame 31 has a side assembly or installation arm 37, 38 each connected to an opposite end of the upper beam 34 with a left-hand assembly arm 37 shown in FIG. 8 and a right-hand assembly arm 38 shown in FIG. 9. The installation or assembly arms 37, 38 are pivotally connected at the outer end of the upper beam 34 of the member 33 so that each arm is pivotally movable about a joint 39 with the axis of the joint extending in the elongated direction of the support member. In FIG. 8 the pivoting movement is indicated by an arrow 40 and is effected by cylinder piston units or so-called arm pivoting cylinders 41. The cylinders 41 are located adjacent the upper ends of the arms 37, 38 and extend between the arm and the member 33.

The apparatus 30 as shown in FIG. 7 is displayded in FIG. 8, on the left-hand side, with the arm 37 in the outwardly pivoted or open position and in FIG. 9 on the right-hand side with the arm 38 in the inwardly pivoted or closed position.

Each assembly arm 37, 38 has a holding device 42 located in its lower region for holding the side guide rails 11 and the function of the holding devices 42 is to be explained further in connection with the description of FIG. 12. In addition at the lower end of each adhere is a stator abutment 43 which can be moved inwardly and into contact with the lower surface 7 of the stator 6, note FIG. 9. At the right-hand side shown in FIG. 9, the assembly arm 38 also has a side adjustment device 44 located above the holding device 62 and the function of this device will be explained below.

The installation truss frames 31 are positioned on a transportation frame 45 ready for transportation, and the transportation frame include two beams 46 extending in the elongated direction of the support member 1 interconnected mainly at the location of the installation truss frames 31 by beams 47 extending transversely of the elongated direction. Preferably, apparatus 30 is utilized in a shop building for carrying out the assembly methods mentioned above. The apparatus 30 can be lifted by a suitable hoist which engages at lifting points 48 on the transportation frame 45, note FIG. 7, so that the apparatus can be positioned on the track support member 1. Exact centering of the transportation frame 45 relative to the long axis of the support member is not required, since the installation truss frames 31 are supported on the transportation frame so as to be laterally displaceable, that is, transversely of the longitudinal axis. Alignment of the transportation frame 45 in the long direction of the track support member 1 can be effected by tensioning devices 50, note the opposite ends of the support member 1 in FIG. 7, with the tensioning device having cylinder piston mean for tensioning the side guide rails 11 which operation will be explained subsequently with regard to FIGS. 13 to 15.

The arrangement of the apparatus 30 with the assembly arms 37, 38 in the open condition is set forth schematically in FIGS. 8 and in greater detail in FIGS. 10 and 12. There is no difference between the assembly arms 37, 38 in the manner of holding and positioning the side guide rails 11. In the open condition, two side guide rails 11, to be secured to the support member 1, are placed in the holding device on the assembly arms 37, 38 by means of a hoist, not shown, and are secured in the devices at a given spacing. At this point, the anchor bolts 17 are already connected to the side guide rails 11, note FIG. 6. From the open condition, the assembly arms 37, 38 are pivoted in the direction of the arrow 40, note FIG. 8, by actuating the arm pivoting cylinders 41. During this operation, attention must be made to the introduction of the anchor bolts 17 into the recesses 15. It may be necessary to slightly raise the installation truss frames 31 for inserting the anchor bolts. The lifting action can be effected by lifting presses 60 depending downwardly from the lower cross beam 35 of the member 33 and the lifting presses can be extended to abut against the upper surface of the support member 1. After the assembly arms 37, 38 have been pivoted inwardly to the closed position, as shown in FIG. 9, the installation truss frames 31 are listed through a height h in the direction of the arrow 61, note FIG. 9, by actuation of the lfting presses 60, until the stator abutments 43 on the lower ends of the arms bear against the lower surface 7 of the stators. When this operation has been completed, the side guide rails 11 are positioned with respect to height.

Next, the installation truss frames are displaced sliding on the transportation frame 45 in the transverse direction relative to the elongated direction of the support member 1 in the direction of the arrow 62, note FIGS. 8 and 9, for positioning the side guide rails 11 relative to the central axis of the support member extending in the long direction. This operation is performed by the side adjustment device 44 located on the right-hand assembly arm 38 and arranged to engage the slide strip 9 adjacent the right-hand side by means of an abutment rod 63. The horizontal transverse movement of the installation truss frame 31 is continued until the side guide rails 11 contact the distance pins 23, note FIG. 3. By these two steps, one in the vertical direction and one in the horizontal direction, both of the guide rails are simultaneously and in common accurately positioned with regard to the stators 6.

The method steps depicted only diagrammatically in FIGS. 8 and 9 for only one side, can be noted with greater clarity in FIGS. 10 and 11. The apparatus employed in carrying out the individual steps of the method can be explained in more detail with the aid of the illustration of the right-hand assembly arm 38 shown on an enlarged scale in FIG. 12.

Assembly arm 38 has an upper bracket 70 formed by the upper end of an inner straight frame member 71 and an outer angled frame member 72. The joint 39 for pivoting the arm 38 is located at the inner end of the bracket 70. At its lower end, the arm 38 has a lower bracket 73 located at the lower ends of the inner frame member 71, and the outer frame member 72. The bracket 73 spaced inwardly from the frame member 71 supports the stator abutment 43 on which a force measuring member 74 or dynamometer is supported.

At the lower end of the inner frame member 71 there are two spaced guide rail abutments 77 with check points 78. The upper abutment 77 rests on an upper support bracket 75 and the lower abutment 77 rests on a lower support bracket 76. In addition, the holding device 42 includes a lower holding slide 79 displaceable in the transverse direction on the lower support bracket 76 by means of a holding cylinder 80. In addition, an upper holding claw 81 which can be pivoted against a side guide rail 11 inserted in the holding device, can be pivoted about an articulation point 82 by an upper holding cylinder 83. With the holding slide 79 moved out of the way and with the holding claw 80 pivoted outwardly, the side guide rail can be placed by a hoist, not shown, on the lower holding slide and by moving the slide and pivoting the upper holding claw 81 the slide guide rail can be pressed against the rail abutments 77. The check points 78 are adjustable so that, the side guide rails 11 are retained on opposite sides of the installation truss frame 71 in the holding devices 42, and are positioned at exactly the desired spacing from one another in the inwardly pivoted or closed position of the assembly rms 37, 38.

After positioning the two side guide rails 11 in the holding devices 42 of the assembly arms 37, 38, the arms are pivoted inwardly by the arm cylinders 41 until the anchor bolts 17 are located a short distance in front of the recesses 15. At this point, the installation truss frames 31 are lifted individually by the lifting cylinders 60 until the bolts 17 can be moved to the recesses 15 if the inwardly pivoting operation is continued, as shown by the dashed lines in FIG. 12. During this operation the stator abutment 43 with its check point 74 is moved inwardly below the lower surface of the stators 6.

A locking device fixes the assembly arms 37, 38 in the closed position and is illustrated in FIG. 12. The locking device includes an abutment plate 84 with an outwardly extending pin 85 located at the end of the lower beam 35 of the installation truss frame 31 and another abutment plate 86 with an opening 87 corresponding to the pin 85, is located on the inner frame member 71. In the inwardly pivoted position of the arm 38, the two abutment plates 84, 86 bear against one another with the pin 85 extending through the opening 87. In addition, pin 85 has a through opening into which a locking wedge 88 on a locking cylinder 89 can pass.

In the locked condition the side guide rails 11 are at the required space relative to one another, however, they are not yet positioned relative to the support member 1. Accordingly, the side guide rail 11 located on the left-hand side must be placed into contact with the distance pins 23, and the right-hand side guide rail 11 is then automatically positioned. To place the left-hand side guide rail 11 in contact with the distance pins 23, note FIG. 3, in the closed position of the assembly arms 37, 38, the side adjustment device 44 is provided with a side actuating cylinder 64 as shown in FIG. 12 and the cylinder is articulated at a butt strap 65 on the outer frame member 72 and presses with the end of its piston rod 66 against a knuckle joint 67 on the end of an abutment rod 63 connected to the joint at a connector 68. At its other end 69, the abutment rod 63 bears loosely on the upper holding claw 81. End 69 slides, when the right-hand assembly arm 38 is pivoted inwardly, over the outer edge region of the cantilevered part 5 in to the position indicated in dashed lines in FIG. 12, where it abuts at the outer flank of the slide strip 9. Upon further actuation of the side adjustment cylnnder 64, the entire installation truss frames 31 can be displaced in a sliding manner on the elongtted beams 46 of the transportation frame 45 until the left-hand slide guide rail 11 contacts the distance pins 23.

In FIG. 11 the closed position of the apparatus is shown. As illustrated, the installation truss frame 31 rests on the lifting presses 60 which are moved upwardly until the stator abutments 43 bear against the lower surface 7 of the stators 6. In this condition, the lower beams 35 of the members 33 are lifted upwardly from the elongated beams 46 of the transportation frame 45. In this condition the side guide rails 11 are fixed not only in the holding device 42 at the required spacing from one another but they are also positioned in the vertical or height direction and in the lateral or transverse direction relative to the track support member 1, so that the side guide rails 11 can be prestressed and fixed to the support member in the prestressed state.

Tensioning device 50 for prestressing the side guide rails 11 is displayed diagrammatically in FIGS. 13 to 15. Beneath the elongated beams 46 of the transportation frame 45 and projecting on the support member 1, there is a cross-tie 51 with two tension butt straps 52 secure to the outer end of the cross-tie by hinge pins 53. Tension butt straps 52 are fastened to the ends of each side guide rail 11 by a connecting bolt 54. A space screw 55 secures the space of the tension butt straps 52 relative to one another, and lock screws 56 secure the connection to the side guide rails 11.

Hydraulic presses 58 are located between the cross-tie 51 and the adjacent end 57 of the track support member 1. The hydraulic presses 58 abut against the end 57 of the support member 1 and transmit tensile force through the cross-tie 51 and the tension butt straps 52 to the side guide rails 11. As described above with regard to FIGS. 3 to 6, the ends of the side guide rails are welded to the anchoring members 19, note FIGS. 2 and 5, after the side guide rails 11 have been prestressed relative to the track support member 1 and the recesses 15 and the spaces between the side guide rails 11 and the outer surfaces of the cantilevered parts 5 are filled with a hardenable material, such as cement mortar. Sealing elements 90 of an elastic material are provided, note FIG. 12, to prevent the cement mortar from flowing downwardly and running out of the intermediate space while the cement mortar is being supplied, and the sealing elements are pressed from below against the open gap by sealing cylinders 11 articulated at the lower support 73 of the assembly arms 37 or 38.

To assure the positional accuracy of the side guide rails 11 while the hardenable material sets all of the adjustment elements must be lockable. In the case of hydraulic presses or cylinder piston units, locking can be effected by set collars or pressure switches.

After the hardenable material has set, initially all of the sealing cylinders are retracted to release the apparatus, then the upper and lower holding cylinders, 83, 80 are retracted and the locking wedges 88 and the side adjustment device 44 are released and finally the installation truss frames are again lowered onto the elongated beams 46 of the transportation frame 45 by retracting the lifting cylinders 60.

The piston rods 94 of the centering cylinders 95 mounted on the upper side of the transverse beams 47 must be moved inwardly prior to the lowering of the installation truss frames 31 so that a centering bracket 96 located at the lower side of the lower beam 35 can be moved between the centering cylinders. In the lowered condition, note FIG. 10, a centering of the installation truss frames 31 is possible through the two centering cylinders 95 acting against one aother with their piston rods 94 acting from both sides against the centering bracket 96 for positioning new side guide rails 11.

A lifting part 97 of a hoist is shown in FIG. 10 which can be moved via a trolley 98 mounted on a special cross-member 100 supported on connecting beams 99 between installation truss frames 31 and afford the handling of the side guide rails 11.

While specific embodiments of the invention have been shown and described in detail to illustrate the application of the invention principles, it will be understood that the invention may be embodied otherwise without departing from such principals.

We claim:

1. Apparatus for positioning and securing operating surfaces of an elongated generally horizontal running track for electromagnetically levitated vehicles comprising a plurality of generally vertically extending installation truss frame disposed in parallel spaced relation with said frames arranged to extend transversely of and above the running track, said installation frames each having a pair of outer generally upwardly extending assembly arms with each said assembly arm pivotally ataached to an opposite end of each of said installationtruss frames at an upper part of said arms, said assembly arms being pivotally displaceable between an outer position spaced outwardly from the running track and an inner position pivoted inwardly from the outer position to adjacent the running track, each said assembly arm having the holding means for holding one side guide rail and an abutment at a lower part thereof for abutting against a lower surface of a stator attached to the running track, a transportation frame arranged to extend in the elongated direction of the running track and to support said installation truss frames, said installation truss frames being displaceable on said transportation frame transverely of the elongated direction of the transportation frame, and means for adjusting said installation truss frames in the vertical direction relative to said transportation frame.

2. Apparatus, as set forth in claim 1, wherein said assembly arms are pivotally movable each around an axis extending parallel to the elongated direction of the support member with the axes being located at the opposite upper side of the said installation truss frames.

3. Apparatus, as set forth in claim 2, wherein means are provided connected to said installation truss frames and to said assembly arms for pivoting said assembly arms between the outer position and the inner position.

4. Apparatus, as set forth in claim 3, including means for locking said assembly arms in the inner position.

5. Apparatus, as set forth in claim 1, wherein a side adjustment device is arranged on one of said assembly arms connected to one said installation truss frame and is arranged to abut against the support member for effecting displacement of the installation truss frame in the inner position of said assembly arm transverse of the elongated direction of the support member.

6. Apparatus, as set forth in claim 5, wherein said means for lateral displacement of said installation truss frame comprises a side adjustment yylinder articlate to the one of said assembly arms with said side adjustment cylinder acting on a support rod movable into engagement with a surface on the support member.

7. Apparatus, as set forth in claim 6, wherein said support road extends transversely of the elongated direction of the support member.

8. Apparatus, as set forth in claim 6, wherein means are articulated between said assembly arm and said support rod for pivoting said support rod about a joint.

9. Apparatus, as set forth in claim 1, wherein lifting means are arranged for abutting against the support member and are connected to said installation truss frames for adjusting the position of said installation truss frames in the vertical direction.

10. Apparatus, as set forth in claim 1, wherein said transportation frame comprises beams extending in the elongated direction of the support member and spaced laterally apart and transverse beams extending between and interconnecting said beams extending in the elongated direction.

11. Apparatus, as set forth in claim 1, wherein each said side guide rail has an upper edge and a lower edge spaced apart in the vertical direction, said holding means comprises a holding slide extending transversely of the elongated direction of the support means and perpendicularly of said assembly arms and arranged to receive a lower edge of a guide rail, a holding claw engaged with the upper edge of the side guide rail, means cooperate with said holding slide and said holding claw for securing the side guide rails on the assembly arm, and said assembly arm having abutments secured thereto for contacting the side guide rail secured by said holding slide and holding claw.

12. Apparatus as set forth in claim 11, wherein a first double-acting holding cylinde is connected to said holding slide and a second double-acting holding cylinder is connected to said holding claw and said first and second holding cylinders being arranged to displace the holding slide and the holding claw into holding engagement with the side guide rail.

13. Apparatus, as set forth in claim 1, wherein said abutment arm on said assembly arm includes a load meansuring device engageable with the stator.

14. Apparatus, as set forth in claim 1, including a sealing element secured to the lower end of each said assembly arm for sealinga gap between the outer side of the support member and the adjacent side guide rail.

15. Apparatus, as set forth in claim 14, wherein movably displaceable means are secured to said sealing element for moving said sealing element toward and away from he gap to be sealed.

16. Apparatus, as set forth in claum 15, wherein said means connected to said sealing element includes a sealing cylinder articulate to the lower end of said assembly arm and to said sealing element for movably displacing the sealing element.

17. Apparatus, as set forth in claim 1, including means for centering said installation truss frames relative to said transportation frame with said centering means located between said transportation frame and said installation truss frames.

18. Apparatus, as set forth in claim 17, wherein said centering means comprises at least one centering cylinder extending transversely of the long direction of the support member and located on an upper side of said transportation frame, and said centering cylinder is in operative connection with one said installation truss frame.

19. Apparatus, as set forth in claim 18, wherein two said centering cylinders are disposed in axial alignment and each said centering cylinder having a piston rod directed toward the piston rod of the other, and said centering means include a centering bracket secured to and extending downwardly from said installation truss frame between said piston rods.

20. Apparatus, as set forth in claim 1, wherein wind bracing connection means interconnect at least two adjacent said installation truss frames.

21. Apparatus, as set forth in claim 20, wherein said wind bracing connection means is arranged for permitting the adjustment of said installation truss frames in the vertical direction and in the direction transverse to the elongated direction of the support member.

22. Apparatus, as set forth in claim 1, wherein a hoist is mounted on at least two of said installation truss frames for lifting the side guide rails.

23. Apparatus, as set forth in claim 1, wherein said transportation frame comprises first beams extending in the elongated direction of the support member and second beams extending transversely of the first beams and connected thereto, said first beams being longer than the support member in the elongated direction, and prestressing means located at the opposite ends of said first beams for prestressing the side guide rails.

24. Apparatus, as set forth in claim 23, wherein said prestressing means comprises a cross tie secured to and extending transversely of said first beams at the ends thereof and tension but straps secured to said cross tie and arranged to engage the side guide rails, and a cylinder piston unit arranged to bear against the ends of the support member and against said cross tie.

25. Apparatus, as set forth in claim 24, wherein said cross tie is supported relative to the first beams of said transportation frame extending in the elongated direction of the support member for displacement in the elongated direction.

* * * * *